US010883742B2

(12) United States Patent
Choi et al.

(10) Patent No.: US 10,883,742 B2
(45) Date of Patent: Jan. 5, 2021

(54) INDUCTION HEATING MODULE AND WATER PURIFIER HAVING THE SAME

(71) Applicant: LG ELECTRONICS INC., Seoul (KR)

(72) Inventors: Kobong Choi, Seoul (KR); Yonghyun Kim, Seoul (KR); Jewook Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 648 days.

(21) Appl. No.: 15/473,707

(22) Filed: Mar. 30, 2017

(65) Prior Publication Data

US 2017/0321931 A1 Nov. 9, 2017

(30) Foreign Application Priority Data

May 4, 2016 (KR) ..... 10-2016-0055459

(51) Int. Cl.

| | |
|---|---|
| ***F24H 7/00*** | (2006.01) |
| ***H05B 6/10*** | (2006.01) |
| ***B67D 1/00*** | (2006.01) |
| ***B67D 1/08*** | (2006.01) |
| ***H05B 6/02*** | (2006.01) |

(Continued)

(52) U.S. Cl.

CPC ..... *F24H 7/002* (2013.01); *B67D 1/0004* (2013.01); *B67D 1/0014* (2013.01); *B67D 1/0859* (2013.01); *B67D 1/0895* (2013.01); *F25D 11/00* (2013.01); *F25D 23/003* (2013.01); *H05B 6/02* (2013.01); *H05B 6/108* (2013.01); *B67D 2210/0001* (2013.01); *B67D 2210/00005* (2013.01); *B67D 2210/00026* (2013.01); *B67D 2210/00118* (2013.01); *F25D 31/003* (2013.01)

(58) Field of Classification Search

None

See application file for complete search history.

(56) References Cited

U.S. PATENT DOCUMENTS 4,869,232 A * 9/1989 Narang ..... F24H 1/207 122/14.1

5,334,819 A * 8/1994 Lin ..... F24H 1/121 219/628

(Continued)

FOREIGN PATENT DOCUMENTS

| | | |
|---|---|---|
| CN | 105517912 | 4/2016 |
| JP | S61233162 | 10/1986 |

(Continued)

OTHER PUBLICATIONS

Chinese Office Action in Chinese Application No. 201710303986.3, dated Feb. 3, 2020, 15 pages (with English translation).

*Primary Examiner* — Ibrahime A Abraham
*Assistant Examiner* — Elizabeth M Sims
(74) *Attorney, Agent, or Firm* — Fish & Richardson P.C.

(57) ABSTRACT

A water purifier includes a working coil, a hot water tank that faces toward the working coil and is spaced apart from the working coil by a gap to heat a liquid passing through an inner space of the hot water tank by an induction of the working coil, a bracket that is coupled to the hot water tank, the working coil being located between the hot water tank and the bracket, and a spacer that is located between the working coil and the hot water tank to thereby define the gap between the working coil and the hot water tank.

20 Claims, 6 Drawing Sheets

(51) Int. Cl.

| | |
|---|---|
| ***F25D 11/00*** | (2006.01) |
| ***F25D 23/00*** | (2006.01) |
| *F25D 31/00* | (2006.01) |

(56) References Cited

U.S. PATENT DOCUMENTS

| | | | | |
|---|---|---|---|---|
| 9,163,855 | B2 | 10/2015 | Akel | |
| 2011/0204042 | A1* | 8/2011 | Wakashima | F25B 13/00 219/635 |
| 2012/0138598 | A1 | 6/2012 | Akel | |
| 2016/0195301 | A1* | 7/2016 | Gaspard | H05B 3/82 392/441 |

FOREIGN PATENT DOCUMENTS

| | | | | | |
|---|---|---|---|---|---|
| JP | 2007134201 | | | 5/2007 | |
| JP | 5369879 | | | 12/2013 | |
| KR | 1020140057184 | | | 5/2014 | |
| KR | 20160001614 | A | * | 4/2015 | H05B 6/365 |
| KR | 20160001614 | A | * | 1/2016 | H05B 6/108 |
| KR | 1020160001614 | | | 1/2016 | |
| WO | WO2015018734 | | | 2/2015 | |

* cited by examiner

INDUCTION HEATING MODULE AND WATER PURIFIER HAVING THE SAME

CROSS-REFERENCE TO RELATED APPLICATIONS

Pursuant to 35 U.S.C. § 119(a), this application claims the benefit of earlier filing date and right of priority to Korean Application No. 10-2016-0055459, filed on May 4, 2016, the contents of which is incorporated by reference herein in its entirety.

FIELD

The present disclosure relates to a water purifier that can generating hot water using an induction heating method.

BACKGROUND

A water purifier is an apparatus that can filter out various hazardous ingredients harmful to human body contained in raw water such as tap water, underground water, or the like by several stages of filters installed within a main body to convert it to safe and sanitary drinking water.

Water purifier is an apparatus for forming a cold water passage and a hot water passage, a purified water passage, and the like to control the flow of water with a mechanical or electronic valve so as to supply purified water that has passed through the filters to a water outlet portion according to a user's selection for the above purpose.

Water purifiers may be classified into a tank type and a tankless type depending on whether a water tank is provided therein. The tank type water purifier is configured to store purified water in the water tank and then provide the purified water stored in the water tank when a user manipulates a water outlet portion thereof. The tankless type water purifier is not provided with a water tank, and configured to immediately filter raw water and provide purified water to a user when the user manipulates a water outlet portion thereof.

A water purifier may provide hot water and cold water in addition to room temperature water. A water purifier for providing hot water and cold water is additionally provided therein with a heating device and a cooling device. The heating device is configured to heat purified water to generate hot water, and the cooling device is configured to cool purified water to generate cold water.

In order to allow the tankless type water purifier to provide hot water or cold water, purified water may be heated or cooled within a short period of time.

Induction heating indicates a heating method of heating an object to be heated using electromagnetic induction. When a current is supplied to a coil, an eddy current is generated on the object to be heated, and Joule heating generated by a resistance of the metal increases the temperature of the object to be heated.

An output value of induction heating varies by a gap between the coil and the object to be heated. For example, when the output value of induction heating exceeds a normal range (high power), water boils to generate steam. When the output value of induction heating does not reach a normal range (low power), purified water is not sufficiently heated.

Accordingly, it is important to constantly maintain a gap between the coil and the object to be heated.

SUMMARY

According to one aspect of the subject matter described in this application, a water purifier includes: a working coil; a hot water tank that faces toward the working coil and is spaced apart from the working coil by a gap and that is configured to heat a liquid passing through an inner space of the hot water tank by an induction of the working coil; a bracket that is coupled to the hot water tank, the working coil being located between the hot water tank and the bracket; and a spacer that is located between the working coil and the hot water tank to thereby define the gap between the working coil and the hot water tank.

Implementations according to this aspect may include one or more of the following features. The spacer may be configured to maintain a constant thickness based on being pressed inward by a coupling force between the hot water tank and the bracket. The spacer may be made from mica, glass, or silicon. The spacer may include a plurality of spacers that are adhered to each other. A first surface of the spacer may be adhered to the hot water tank, a second surface of the spacer opposite the first surface may be adhered to the working coil, and a thickness of the spacer may determine the gap between the hot water tank and the working coil.

The working coil may be made from a conducting wire wound into an annular shape, and the spacer may be shaped to correspond to the annular shape of the working coil. The spacer may further include a first portion that defines all or a portion of the annular shape and a second portion that is narrower than the first portion in a radial direction. The hot water tank and the working coil may be exposed to each other through a hole that is defined in a surface of the spacer.

The bracket may include a plurality of boss portions that are spaced apart from each other, the hot water tank and the bracket may be coupled to each other by screws inserted through the boss portions, and an edge of the hot water tank may be located between a head of the screw and the boss portion. The bracket may include: a base portion that faces toward the working coil; and a plurality of hot water tank support portions that are spaced apart from each other, that protrude from the base portion, and that are configured to support the hot water tank.

The water purifier may further include an insulator that is located between the working coil and the bracket and that is configured to restrict heat conduction between the insulator and the working coil. The insulator may be made from mica, glass, or silicon. The insulator may define a hole in a surface of the insulator. The working coil may be made from a conductive wire wound in an annular shape, and the spacer and the insulator are shaped to correspond to the annular shape. The insulator may include a first portion that defines all or a portion of the annular shape and a second portion that is narrower than the first portion in a radial direction. The bracket may include a position fixing portion that protrudes toward the working coil along an inner circumference of the annular shape and that is configured to guide the working coil, the spacer, and the insulator to a fixed position.

The water purifier may further include a temperature sensor that is located at an inner side of the annular shape and that is configured to measure a temperature and a fuse that is located at an inner side of the annular shape and that is configured to operate based on the temperature being above a preset temperature, and the induction may be controlled based on the temperature measured by the temperature sensor.

BRIEF DESCRIPTION

DETAILED DESCRIPTION

Figure 1:
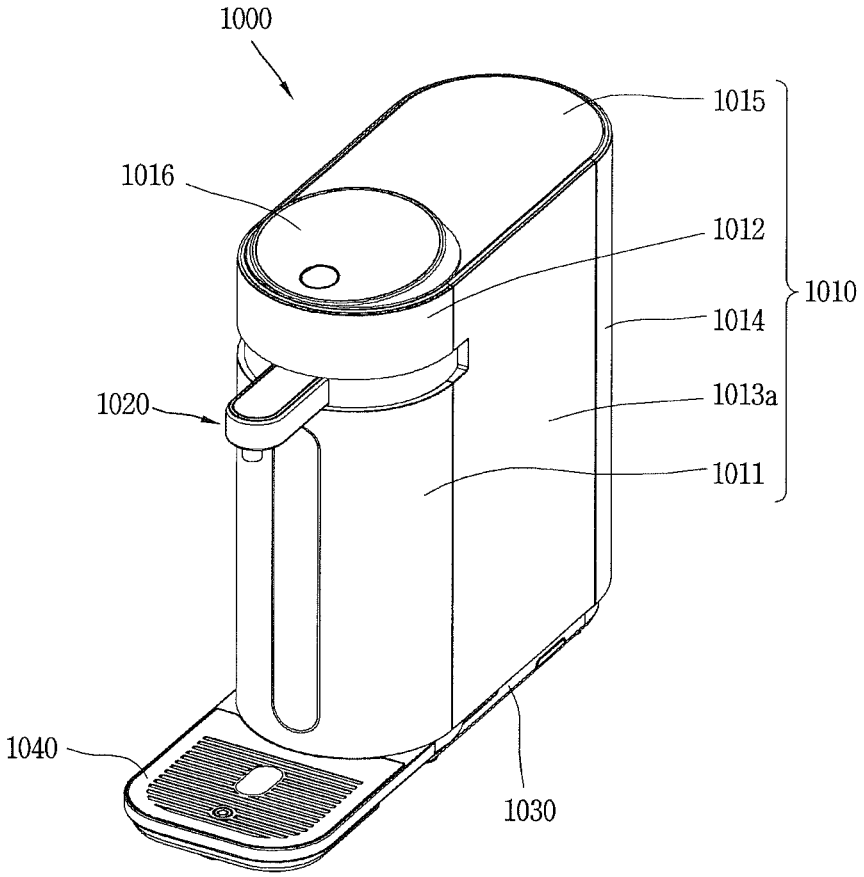
FIG. 1 is a perspective view showing an outer appearance of an example water purifier.

FIG. 1 illustrates a water purifier 1000.

The water purifier 1000 may include a cover 1010, a water outlet portion 1020, a base assembly 1030, and a tray 1040.

The cover 1010 forms an outer appearance of the water purifier 1000. An outer appearance of the water purifier 1000 may be referred to as a body of the water purifier 1000. Components for filtering raw water are provided within the cover 1010. The cover 1010 surrounds the components to protect the components. The term cover 1010 may be replaced with a case or housing in the following description. As far as it is configured to form an outer appearance of the water purifier 1000 and surround components for filtering raw water, it refers to the cover 1010.

The cover 1010 may be made from a single component or a combination of several components. For an example, as illustrated in FIG. 1, the cover 1010 may include a front cover 1011, a rear cover 1014, a side panel 1013*a*, an upper cover 1012 and a top cover 1015.

The front cover 1011 is disposed at a front side of the water purifier 1000. The rear cover 1014 is disposed at a rear side of the water purifier 1000. The front side of the water purifier 1000 are set based on a direction in which the water outlet portion 1020 is facing a user. However, the concept of the front side and rear side of the water purifier 1000 may not be absolute, and thus may vary according to a method of describing the water purifier 1000.

The side panels 1013*a* are disposed on the left and the right of the water purifier 1000. The side panel 1013*a* is disposed between the front cover 1011 and the rear cover 1014. The side panel 1013*a* may be coupled to the front cover 1011 and rear cover 1014. The side panel 1013*a* may cover most area of a side surface of the water purifier 1000.

The upper cover 1012 is disposed at a front side of the water purifier 1000. The upper cover 1012 is provided vertically above the front cover 1011. The water outlet portion 1020 is exposed in a space between the upper cover 1012 and the front cover 1011. The upper cover 1012 forms an outer appearance of a front surface of the water purifier 1000 along with the front cover 1011.

The top cover 1015 forms an upper surface of the water purifier 1000. An input/output portion 1016 may be formed at a front side of the top cover 1015. The input/output portion 1016 has an input portion and an output portion. The input portion is configured to receive a user's control command. A method of receiving a user's control command at the input portion may include a touch input, a physical pressure, or the like. The output portion is configured to provide the status information of the water purifier 1000 to the user in an audio-visual manner.

The water outlet portion 1020 or cork assembly provides purified water to a user according to the user's control command. At least part of the water outlet portion 1020 is exposed to an outside of the body of the water purifier 1000 to supply water. In some implementations, the water purifier 1000 may be configured to provide cold water at a temperature lower than the ambient temperature, hot water at a temperature higher than the ambient temperature, or both. At least one of hot water, cold water, and purified water at the ambient temperature may be discharged through the water outlet portion 1020 according to a control command applied from a user.

The water outlet portion 1020 may be configured to rotate according to a user's manipulation. The front cover 1011 and the upper cover 1012 may include a rotation region of the water outlet portion 1020 therebetween, and the water outlet portion 1020 may be rotated in the left and right directions in the rotation region. The rotation of the water outlet portion 1020 may be carried out by a force physically applied to the water outlet portion 1020 by the user. The rotation of the water outlet portion 1020 may be carried out based on a control command applied to the input/output portion 1016 by the user. A structure that enables the rotation of the water outlet portion 1020 may be installed within the water purifier 1000 and covered by the upper cover 1012. In some implementations, the input/output portion 1016 may rotate along with the water outlet portion 1020 during the rotation of the water outlet portion 1020.

The base 1030 forms a bottom of the water purifier 1000. Components within the water purifier 1000 are supported by the base 1030. When the water purifier 1000 is mounted on a floor, a shelf, or the like, the base 1030 may face down toward the floor, the shelf, or the like. Accordingly, when the water purifier 1000 is mounted on the floor, the bottom or the like, the structure of the base 1030 is not exposed to an outside.

The tray 1040 is disposed to face the water outlet portion 1020. As illustrated in FIG. 1, the tray 1040 may support a container or the like for storing purified water or the like provided through the water outlet portion 1020. The tray 1040 may receive residual water falling from the water outlet portion 1020. When the tray 1040 receives and collects residual water falling from the water outlet portion 1020, it may be possible to limit or prevent a spill of the residual water around the water purifier 1000. In some implementations, the tray 1040 may be also rotate along with the water outlet portion 1020 to receive residual water falling from the water outlet portion 1020. The input/output portion 1016 and tray 1040 may rotate in the same direction as that of the water outlet portion 1020.

Figure 2:
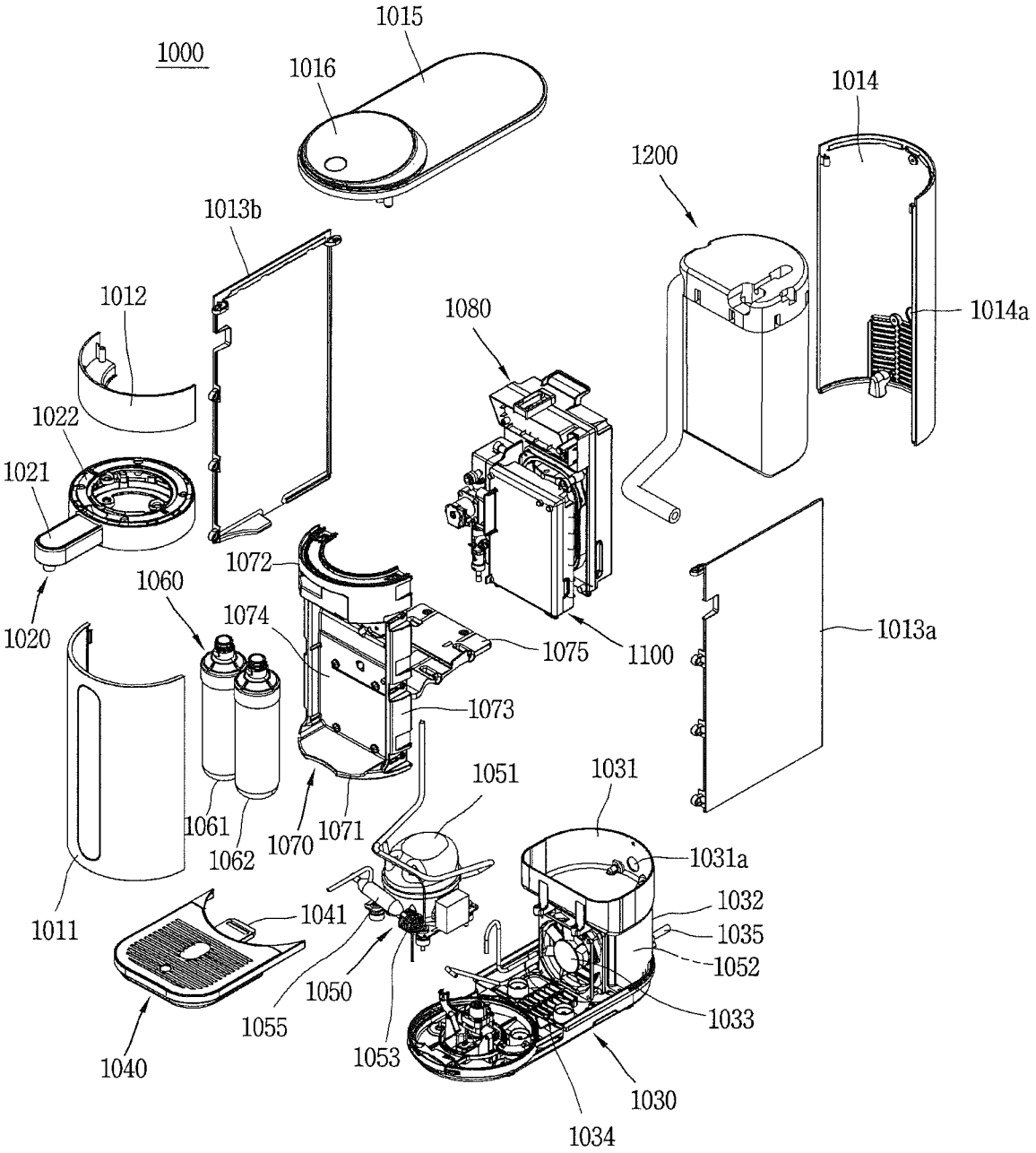
FIG. 2 is an exploded perspective view showing an internal configuration of the example water purifier.

FIG. 2 illustrates an internal configuration of an example water purifier 1000. A filter portion 1060 is installed at an inside of the front cover 1011. The filter portion 1060 is configured to filter raw water supplied from a raw water supply unit to generate purified water. Because purifying water is difficult using only one filter, the filter portion 1060 may include a plurality of unit filters 1061, 1062. The unit filters 1061, 1062 may include a prefilter such as carbon black, absorption filter or the like, and a high-performance filter such as a high efficiency particulate air (HEPA) filter, UF (ultra filtration) filter, or the like. As illustrated in FIG. 2, two unit filters 1061, 1062 are installed, but the number of unit filters 1061, 1062 may be increased or decreased as needed.

A plurality of unit filters 1061, 1062 are connected in a preset order. The preset order denotes an appropriate order for filtering water. Raw water may include various foreign substances. Large-sized particles such as hairs or dust may cause the filtration performance deterioration of the high-performance filters such as a HEPA filter or UF filter, and thus the high-performance filters may be protected from large-sized particles such as hairs or dust may. Accordingly, a prefilter may be installed at an upstream side of the high performance filters.

The prefilter is configured to remove large-sized particles from water. When the prefilter is disposed at an upstream side of the high-performance filters to first remove large-sized particles contained in raw water, water that does not contain large-sized particles may be supplied to the ultra filtration filter to protect the ultra filtration filter. The raw water that has passed through the prefilter is subsequently filtered by the HEPA filter, UF filter, or the like.

The purified water produced by the filter portion 1060 may be immediately provided to a user through the water outlet portion 1020. In some implementations, the temperature of purified water provided to the user corresponds to the ambient temperature. In some implementations, the purified water produced by the filter portion 1060 may be heated by the induction heating module 1100 and cooled by the cold water tank assembly 1200.

A filter bracket assembly 1070 is a structure for fixing the unit filters 1061, 1062 of the filter portion 1060, and components such as a water outlet passage, a valve, a sensor, or the like.

A lower portion 1071 of the filter bracket assembly 1070 is coupled to the tray 1040. The lower portion 1071 of the filter bracket assembly 1070 is formed to accommodate a protrusion coupling portion 1041 of the tray 1040. As the protruded coupling portion 1041 of the tray 1040 is inserted into the lower portion 1071 of the filter bracket assembly 1070, a coupling between the filter bracket assembly 1070 and the tray 1040 is carried out.

The lower portion 1071 of the filter bracket assembly 1070 and the tray 1040 have a curved surface corresponding to each other. The lower portion 1071 of the filter bracket assembly 1070 may be independently rotated from the remaining portion of the filter bracket assembly 1070.

An upper portion 1072 of the filter bracket assembly 1070 is configured to support the water outlet portion 1020. The upper portion 1072 of the filter bracket assembly 1070 forms a rotation path of the water outlet portion 1020. The water outlet portion 1020 may be divided into an outlet cork portion 1021 protruded to an outside of the water purifier 1000 and a rotation portion 1022 disposed within the water purifier 1000. The rotation portion 1022 may be formed in a circular shape as illustrated in FIG. 2. The rotation portion 1022 is mounted on the upper portion 1072 of the filter bracket assembly 1070. The water outlet portion 1020 mounted on the upper portion 1072 of the filter bracket assembly 1070 is configured to relatively rotate with respect to the filter bracket assembly 1070.

The lower portion 1071 and upper portion 1072 of the filter bracket assembly 1070 may be connected to each other by a top-down connecting portion 1073. The lower portion 1071 and upper portion 1072 of the filter bracket assembly 1070 connected to each other by top-down connecting portion 1073 may be rotated together in the same direction. If a user rotates the water outlet portion 1020, the upper portion 1072, top-down connecting portion 1073, lower portion 1071 and tray 1040 of the filter bracket assembly 1070 may be rotated along with the water outlet portion 1020.

A filter installation region 1074 configured to receive the unit filters 1061, 1062 of the filter portion 1060 may be formed between the lower portion 1071 and upper portion 1072 of the filter bracket assembly 1070. The filter installation region 1074 provides an installation space of the unit filters 1061, 1062.

A support fixture 1075 protruded toward a rear side of the water purifier 1000 is formed at an opposite side to the filter installation region 1074. The support fixture 1075 is configured to support the control module 1080 and induction heating module 1100. The control module 1080 and induction heating module 1100 are mounted on the support fixture 1075. The support fixture 1075 is disposed between the induction heating module 1100 and the compressor 1051 to block heat formed from the induction heating module 1100 from being conducted to a compressor 1051 or the like.

The control module 1080 is configured to implement the overall control of the water purifier 1000. Various printed circuit boards for controlling the operation of the water purifier 1000 may be integrated into the control module 1080.

The induction heating module 1100 is formed to heat purified water produced from the filter portion 1060 to produce hot water. The induction heating module 1100 may include components capable of heating purified water with an induction heating method. The induction heating module 1100 receives purified water from the filter portion 1060, and hot water produced from the induction heating module 1100 is discharged through the water outlet portion 1020.

The induction heating module may include a printed circuit board for controlling hot water production. A protection cover 1161 for protecting water from being infiltrated into the printed circuit board and protecting the printed circuit board in the event of fire may be coupled to one side of the induction heating module.

The refrigerating cycle device 1050 may be provided to produce cold water. The refrigerating cycle device 1050 indicates a set of devices in which the processes of compression-condensation-expansion-evaporation of refrigerant are consecutively carried out. In order to produce cold water from the cold water tank assembly 1200, the refrigerating cycle device 1050 may first cool the water within the cold water tank assembly 1200 to a lower temperature.

The refrigerating cycle device 1050 may include a compressor 1051, a condenser 1052, a capillary 1053, an evaporator disposed at an inside of the cold water tank assembly, a dryer 1055, and a refrigerant passage connecting them to each other. The refrigerant passage may be formed by a pipe or the like that connects the compressor 1051, the condenser 1052, the capillary 1053, and the evaporator to each other to form a circulation passage of refrigerant.

The compressor 1051 is configured to compress the refrigerant. The compressor 1051 is connected to a condenser 1052 by a refrigerant passage, and refrigerant compressed in the compressor flows to the condenser 1052 through the refrigerant passage. The compressor 1051 may be disposed below the support fixture 1075 and above the base 1030.

The condenser 1052 is configured to condense the refrigerant. The refrigerant compressed in the compressor 1051 flows into the condenser 1052 through the refrigerant passage, and is condensed by the condenser 1052. The refrigerant condensed by the condenser 1052 flows into a dryer 1055 through the refrigerant passage.

The dryer 1055 is configured to remove moisture from refrigerant. In order to enhance the efficiency of the refrigerating cycle device 1050, moisture may be removed in advance from refrigerant introduced into a capillary 1053. The dryer 1055 is installed between the condenser 1052 and capillary 1053 to remove moisture from refrigerant, thereby enhancing the efficiency of the refrigerating cycle device 1050.

The expansion of refrigerant is implemented by the capillary 1053. The capillary 1053 is configured to expand refrigerant, and according to the design, a throttle valve or the like may constitute an expansion device instead of the capillary 1053. The capillary 1053 may be rolled in a serpentine shape to secure a sufficient length within a small space.

The evaporator is configured to evaporate the refrigerant, and installed at an inner side of the cold water tank assembly 1200. The water filled at an inner side of the cold water tank assembly 1200 and the refrigerant in the refrigerating cycle device 1050 exchange heat with each other by the evaporator, and the cold water may be maintained at a low temperature. Additionally, purified water may be cooled by the cold water.

The refrigerant heated by exchanging heat with the cooling water in the evaporator returns to the compressor 1051 along the refrigerant passage to continuously circulate the refrigerating cycle device 1050.

The base 1030 is formed to support the compressor 1051, front cover 1011, rear cover 1014, two side panels 1013*a*, 1013*b*, filter bracket assembly 1070, condenser 1052, fan 1033, and the like. The base 1030 may preferably have a high rigidity to support the constituent elements.

The condenser 1052 and fan 1033 may be installed at a rear side of the water purifier 1000, and the circulation of air is continuously required for the dissipation of the condenser 1052. An intake port 1034 may be formed at the floor of the base 1030 to circulate air. Air inhaled through the intake port 1034 flows by the fan 1033. Air implements the cooling of the air cooling method while flowing toward the condenser 1052. A duct structure 1032 for surrounding the fan 1033 and condenser 1052 may be fixed to the base 1030 to enhance the dissipation efficiency of the condenser 1052.

A drain 1035 may be installed at a rear side of the duct structure 1032. The drain 1035 is exposed to an outer side of the water purifier 1000 to form a drain passage. Since the internal passages of the water purifier 1000 are configured to pass through all the components, the water existing in the internal passages may be all exhausted through the drain 1035 even if the drain 1035 is connected to any one internal passage.

A stand 1031 for supporting the cold water tank assembly 1200 may be installed at an upper portion of the condenser 1052. The stand 1031 is provided with a first hole 1031*a* at a rear side and the rear cover 1014 is provided with a second hole 1014*a*. The first hole 1031*a* and the second hole 1014*a* are formed at the corresponding positions to each other. The first hole 1031*a* and the second hole 1014*a* are provided to dispose the drain valve for the drainage of cooling water filled in the cold water tank assembly 1200.

The cold water tank assembly 1200 is formed to receive cooling water within the cold water tank assembly 1200. The cold water tank assembly 1200 receives purified water produced from the filter portion 1060. In some implementations with a tankless type water purifier, the cold water tank assembly 1200 may directly receive purified water from the filter portion 1060.

The temperature of the water filled in the cold water tank assembly 1200 may be decreased by the operation of the refrigerating cycle device 1050. The cold water tank assembly 1200 is configured to cool purified water.

Since the cold water is stored in the cold water tank assembly 1200 without circulation, a contamination level of the cold water may increase with time. For sanitary reasons, the cold water stored in the cold water tank assembly 1200 may be periodically discharged to an outside, and new cold water may be filled into the cold water tank assembly 1200.

Figure 3:
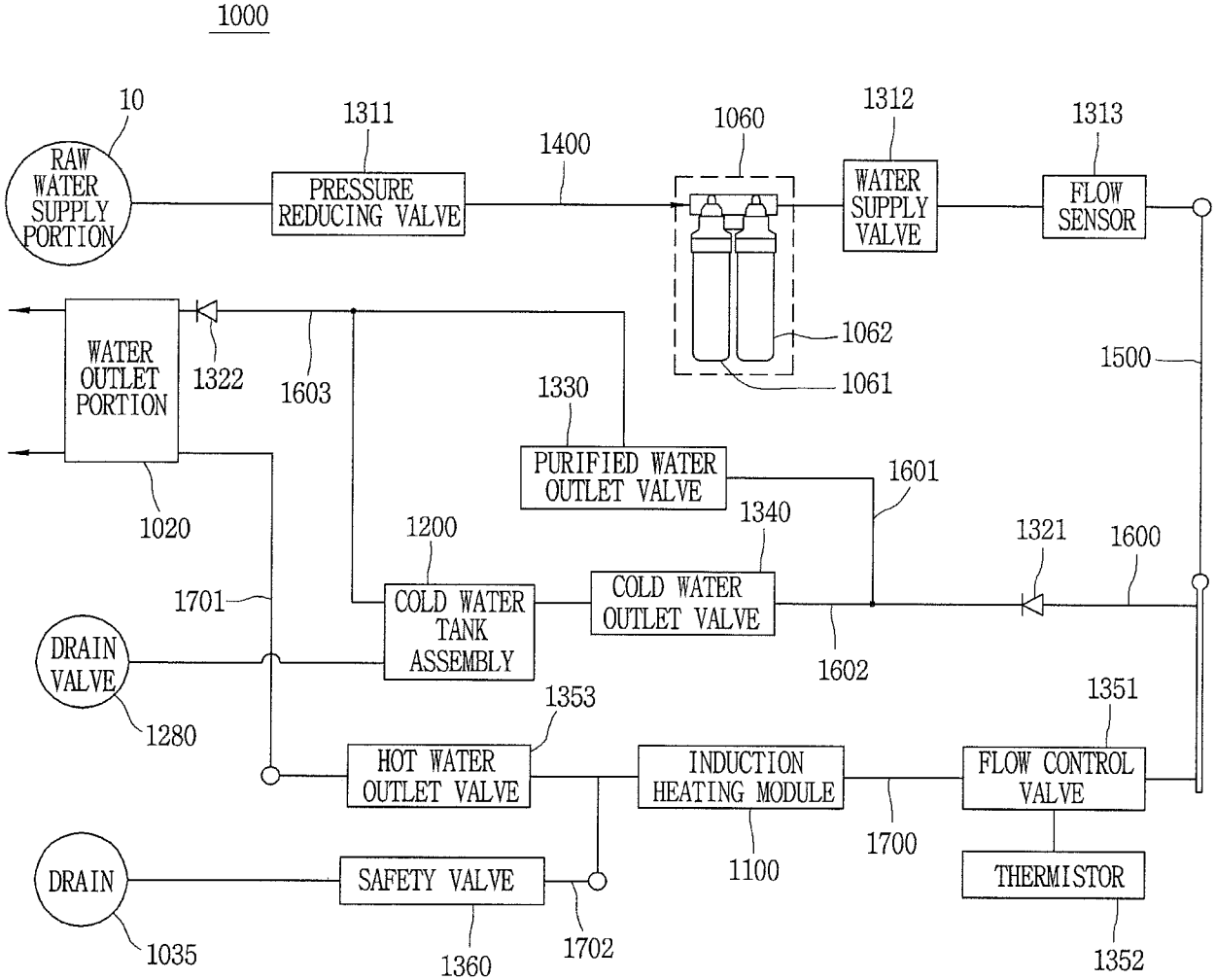
FIG. 3 is a conceptual view showing an example passage configuration of the example water purifier.

FIG. 3 illustrates an example passage configuration of an example water purifier 1000. A solid line in FIG. 3 indicates a passage of water. For the passage of water, an upstream side of the filter portion 1060 and a downstream side of the filter portion 1060 may be divided into a raw water line 1400 and a purified water line 1500 based on the filter portion 1060. Here, the upstream or downstream side is divided based on the flow of water.

A water supply valve 1312 is open or closed based on a control command received through the input portion 1016 of FIG. 1. When a control command for discharging purified water, hot water or cold water is received through the input portion 1016, the water supply valve 1312 is open, and the supply of raw water is carried out from the raw water supply portion 10 to the filter portion 1060.

Raw water passes through a pressure reducing valve 1311 during the process of being supplied to the filter portion 1060. The pressure reducing valve 1311 is installed between the raw water supply portion 10 and the filter portion 1060. The pressure reducing valve 1311 is configured to reduce a pressure of raw water supplied from the raw water supply portion 10.

In some implementations, the tankless type water purifier 1000 may not be provided with a water tank, and thus a pressure of purified water discharged through the water outlet portion 1020 is determined by a pressure of raw water supplied from the raw water supply portion 10. Because a pressure of raw water supplied from the raw water supply portion 10 may be high, the water is discharged at a high pressure from the water outlet portion 1020 if there is no pressure reducing valve 1311. There may exist a danger in which the unit filters 1061, 1062 of the filter portion 1060 are physically damaged by a pressure of raw water. Accordingly, the pressure reduction of raw water is required.

The pressure reducing valve 1311 reduces a pressure of raw water supplied from the raw water supply portion 10 to the filter portion 1060. As a result, the filter portion 1060 may be protected, and water may be discharged at an appropriate pressure from the water outlet portion 1020.

Raw water is sequentially filtered while passing through the unit filters 1061, 1062 of the filter portion 1060. Water at an upstream side may be referred to as raw water, and water at a downstream side may be referred to as purified water based on the filter portion 1060.

Purified water generated from the filter portion 1060 passes through the water supply valve 1312 and a flow sensor 1313. The flow sensor 1313 is configured to measure a flow rate supplied from the filter portion 1060. The flow rate measured at the flow sensor 1313 is used for the control of the water purifier.

For example, when a control command for discharging a predetermined amount of purified water is received through the input portion 1016, a pulse value corresponding to the predetermined value is received at the flow sensor 1313 by the control module 1080, and the water supply valve 1312 is opened by the control of the control module 1080. When the measured flow rate of purified water is over the pulse value, the control module 1080 receives a feedback signal from the flow sensor 1313 to control the water supply valve 1312, and the water supply valve 1312 is closed by the control of the control module 1080. A flow rate measured at the flow sensor 1313 through the foregoing process or the like may be used for the control of the water purifier 1000.

The purified water line 1500 connected to the flow sensor 1313 is branched into two sections 1600, 1700, and one section is connected to a flow control valve 1351 and the induction heating module 1100. This section connected to the flow control valve 1351 and the induction heating module 1100 may be referred to as a hot water line 1700. A check valve 1321 is installed at the remaining one section 1600, and this section is branched again into a purified water line 1601 and a cold water line 1602 at a downstream side of the check valve 1321. A purified water outlet valve 1330 is installed at the purified water line 1601, and a cold water outlet valve 1340 is installed at the cold water line 1602. The purified water line 1601 and cold water line 1602 are merged into one again and connected to the water outlet portion 1020, and a check valve 1322 is installed at the merged passage 1603.

Two check valves 1321, 1322 may be installed at an upstream and a downstream side of the cold water outlet valve 1340. The cold water outlet valve 1340 may be referred to as a first check valve 1321 and a second check valve 1322. The first check valve 1321 and second check valve 1322 are provided to prevent the generation of residual water.

When a control command for supplying hot water is received at the water is purifier, the water supply valve 1312, the flow control valve 1351 and a hot water outlet valve 1353 are open, and hot water is discharged through the hot water line 1700. During the process, a pressure within the purified water line 1601 and cold water line 1602 may decrease to cause a phenomenon in which the purified water outlet valve 1330 or cold water outlet valve 1340 are briefly open and then closed. In some implementation there may not be a problem of residual water in a structure in which the water outlet portion 1020 has only one outlet cork, and both cold water and hot water are discharged through the outlet cork. In some implementations, a structure in which both cold water and hot water are discharged through two different outlet corks, a small amount of residual water may be discharged from either one outlet cork while hot water is discharged from the other outlet cork.

In some implementations, when the first check valve 1321 is installed at an upstream side of a branch point between the purified water line 1500 and the cold water line 1602, it may be possible to block a pressure change formed during the process of discharging hot water through the hot water line 1700 from being transferred to the purified water line 1601 and cold water line 1602. As a result, it may be possible to prevent the occurrence of a phenomenon in which the purified water outlet valve 1330 or cold water outlet valve 1340 from being instantaneously opened and then closed.

When a configuration in which the cold water outlet valve 1340 is installed at an upstream side of the cold water tank assembly 1200 and a configuration in which the which the cold water outlet valve 1340 is installed at a downstream side of the cold water tank assembly 1200 are compared with each other, it may allow the former to obtain even a little more cold water compared to the latter. It is because an amount of cold water depends on a passage length between the cold water tank assembly 1200 and the cold water outlet valve 1340 can be further supplied. Accordingly, the cold is water outlet valve 1340 may be preferably installed at an upstream side of the cold water tank assembly 1200 as illustrated in the drawing. However, in a structure in which the cold water outlet valve 1340 is installed at an upstream side of the cold water tank assembly 1200, residual water may be generated by a pressure change within the cold water line 1602, and a small amount of residual water may be discharged through the water outlet portion 1020 even though the discharge of water is stopped.

When the second check valve 1322 is installed at the merging passage 1603 between the purified water line 1601 and the cold water line 1602, it may be possible to block a pressure change of the cold water line 1602 from being transferred to the water outlet portion 1020.

The purified water that has passed through the flow sensor 1313 may be immediately supplied to a user in a room-temperature state or supplied to a user subsequent to becoming hot water or cold water.

The purified water outlet valve 1330 and cold water outlet valve 1340 may be configured to open or close based on a control command received through the input portion 1016. When a control command for discharging purified water is received through the input portion 1016, the water supply valve 1312 and purified water outlet valve 1330 are open. Purified water generated from the filter portion 1060 is discharged to the water outlet portion 1020 through the purified water line 1601. Similarly, when a control command for discharging cold water is received through the input portion 1016, the water supply valve 1312 and cold water outlet valve 1340 are open. The purified water generated from the filter portion 1060 is introduced into the cold water tank assembly 1200 along the cold water line 1602 and cooled while passing through the cold water tank assembly 1200. The cold water generated from the cold water tank assembly 1200 is discharged through the water outlet portion 1020.

The drain valve 1280 may be installed at the cold water tank assembly 1200, the water filled in the cold water tank assembly 1200 may be discharged to an outside through the drain valve 1280 if necessary.

The flow control valve 1351 is installed on the hot water line 1700 to introduce only an appropriate amount of water for the heating capacity of the induction heating module. The flow control valve 1351 is installed at an upstream side of the induction heating module 1100 and formed to adjust a flow rate of purified water introduced into the hot water tank 1130.

A thermistor 1352 may be also installed at the flow control valve 1351. The temperature of purified water measured by the thermistor 1352 is used for the control of the induction heating module 1100. For example, when the temperature of purified water measured by the thermistor 1352 is low, the induction heating module 1100 may operate at a high power. When the temperature of purified water measured by the thermistor 1352 is high, the induction heating module 1100 may operate at a low power.

The hot water outlet valve 1353 is installed at a downstream side of the hot water tank 1130. When a control command for discharging hot water is received through the input portion 1016, the water supply valve 1312 and hot water outlet valve 1353 are open to discharge hot water along the hot water line 1700.

A safety valve 1360 may be installed on a passage branched from the hot water line 1700. The safety valve 1360 is formed to operate due to a pressure change formed on the passage of the water. When the passage of the water purifier 1000 is excessively pressurized such as a case where the induction heating module 1100 is abnormally operated, the safety valve 1360 is open, and purified water is discharged through the drain 1035.

Figure 4:
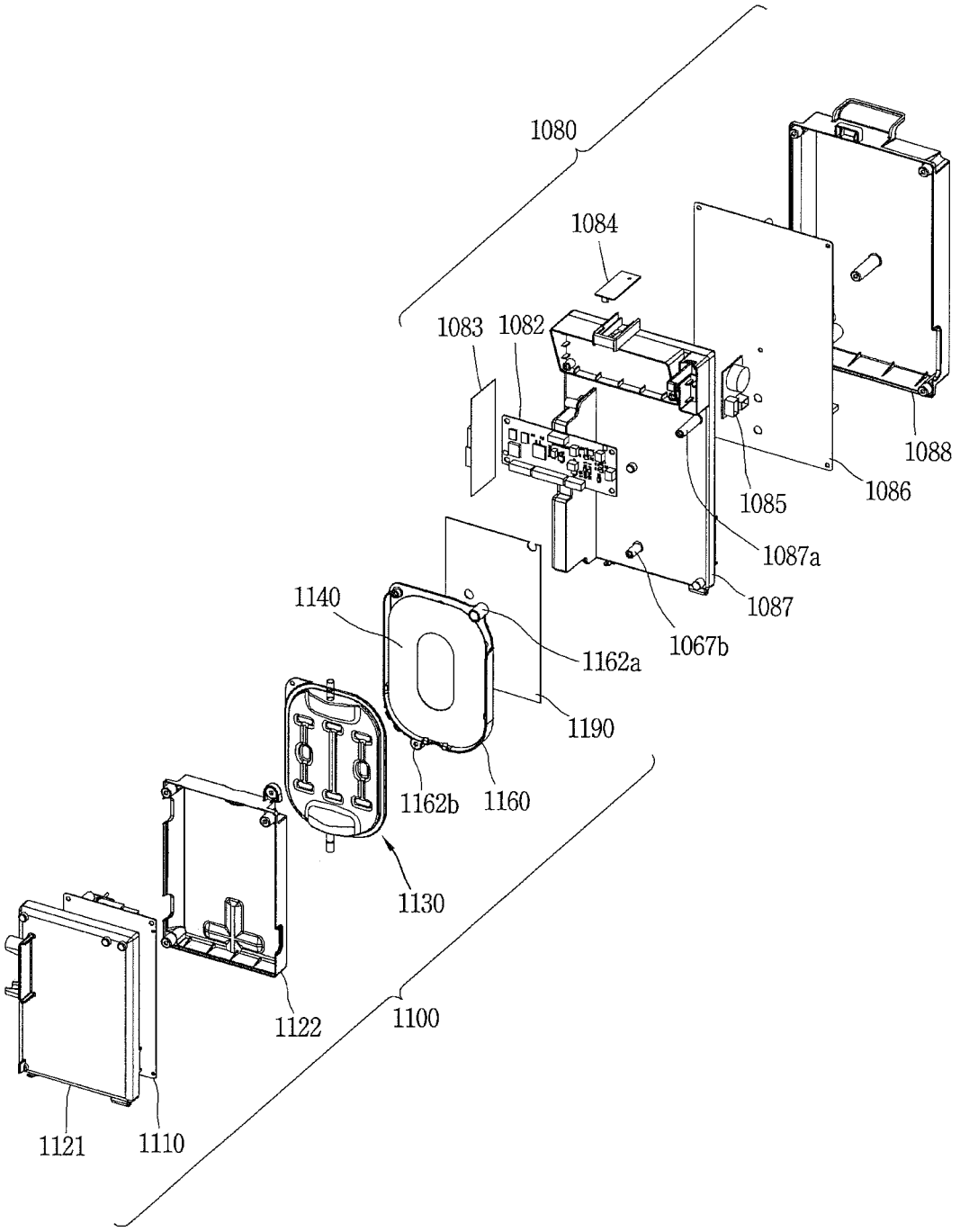
FIG. 4 is an exploded perspective view showing an example induction heating module and an example control module.

FIG. 4 is an exploded perspective view illustrating an example induction heating module 1100 and an example control module 1080.

The induction heating module 1100 indicates a set of components for receiving purified water produced from the filter portion 1060 to produce hot water. In some implementations, a tankless type water purifier 1000 may not be provided with an additional water tank, and purified water may be directly supplied to the induction heating module 1100 from the filter portion 1060.

The induction heating module 1100 may include an induction heating printed circuit board 1110, an induction heating printed circuit board cover 1121, 1122, a hot water tank 1130, a working coil 1140, a bracket 1160, and a shield plate 1190.

The induction heating printed circuit board 1110 controls an induction heating operation of the working coil 1140. Both ends of the working coil 1140 is connected to the induction heating printed circuit board 1110 and controlled by the induction heating printed circuit board 1110. For example, when a user enters a control command through the input portion 1016 of the water purifier 1000 to dispense hot water, purified water produced from the filter portion 1060 is supplied to the hot water tank 1130. The induction heating printed circuit board 1110 controls the working coil 1140 to flow a current. The hot water tank 1130 is induction-heated by a current supplied to the working coil 1140. Purified water is instantaneously heated while passing through the hot water tank 1130 to become hot water.

The induction heating printed circuit board covers 1121, 1122 are configured to surround the induction heating printed circuit board 1110. The induction heating printed circuit board covers 1121, 1122 may include a first induction heating cover 1121 and a second induction heating cover 1122.

The induction heating printed circuit board 1110 is installed in an inner space formed by the first induction heating cover 1121 and second induction heating cover 1122. The first induction heating cover 1121 and second induction heating cover 1122 are coupled to each other by the edges thereof to prevent the infiltration of water. Furthermore, a sealing member configured to prevent the infiltration of water may be coupled to the edges of first induction heating cover 1121 and second induction heating cover 1122. The first induction heating cover 1121 and second induction heating cover 1122 may be preferably formed of a flame retardant material to prevent the damage of the induction heating printed circuit board 1110 due to fire.

The purified water is heated in the hot water tank 1130 heats. The hot water tank 1130 is configured to receive induction heat by the effect of magnetic field formed by the working coil 1140. The purified water becomes hot while passing through the inner space of the hot water tank 1130 that is configured to maintain airtight sealing.

In some implementations, the hot water tank 1130 may be implemented as a small form factor component for a water supply apparatus such as the water purifier 1000, a refrigerator, or the like. A thickness as well as a length or width of the hot water tank 1130 may be reduced compared to the related art to implement the miniaturization of the water supply apparatus. Accordingly, it may be possible to easily implement the miniaturization of the supper supply apparatus. For example, the hot water tank 1130 may be formed in a flat shape. In some implementations, an example hot water tank 1130 in a flat shape may have several problems.

The first problem may be deformation of the hot water tank 1130. When liquid is heated in the inner space of the hot water tank 1130, the liquid is expanded. According to the expansion of liquid, the pressure of the inner space is abruptly increased. The abrupt increase of the pressure causes the deformation of the hot water tank 1130.

The second problem may be insufficient heating. When liquid is heated using a large-sized hot water tank assembly 1130, a time required to heat liquid is sufficient, and thus the liquid may be sufficiently heated. However, the small-sized hot water tank 1130 may not have a sufficient time to heat the liquid, and thus there is a concern of insufficient heating supplied to the water passing through the hot water tank.

Although the above two problems may not be necessarily caused by the miniaturization of the hot water tank 1130, the severity of the problems may further increase as the hot water tank 1130 becomes smaller. The hot water tank 1130 of the present disclosure has a structure capable of solving the problems. The detailed structure of the hot water tank 1130 will be described later with reference to FIG. 5. The working coil 1140 forms magnetic field lines for the induction heating of the hot water tank 1130. The working coil 1140 is disposed at one side of the hot water tank 1130 to face the hot water tank 1130. When a current is supplied to the working coil 1140, magnetic field lines are formed from the working coil 1140. The magnetic field lines gives an effect on the hot water tank 1130, and the hot water tank 1130 receives the effect of magnetic field lines to implement induction heating.

The shield plate 1150 is disposed at one side of the working coil 1140. The shield plate 1150 is disposed at an opposite side of the hot water tank 1130 based on the working coil 1140. The shield plate 1150 is to prevent magnetic field lines generated from the working coil 1140 from being radiated into the remaining region excluding the hot water tank 1130. The shield plate 1150 may be formed of aluminium or other materials for changing the flow of magnetic field lines.

The control module 1080 may include a control printed circuit board 1082, a noise printed circuit board 1083, a near field communication (NFC) printed circuit board 1084, a buzzer 1085, a main printed circuit board 1086, and main printed circuit board covers 1087, 1088.

The control printed circuit board 1082 is a sub-configuration of a display printed circuit board. The control printed circuit board 1082 is not an essential configuration for driving a water supply apparatus such as the water purifier 1000, but performs the secondary role of the display printed circuit board.

The noise printed circuit board 1083 is to provide power to the induction heating printed circuit board 1110. Because induction heating requires a high output voltage, sufficient power should be supplied. The noise printed circuit board 1083 is not an essential configuration for driving a water supply apparatus such as the water purifier 1000. However, the water supply apparatus such as the water purifier 1000 may have the noise printed circuit board 1083 to prepare for a case where power required for induction heating is not sufficiently supplied. The noise printed circuit board 1083 may supply additional power to the induction heating printed circuit board 1110 to satisfy an output voltage for induction heating. The noise printed circuit board 1083 may perform the role of providing secondary power to other configurations as well as the induction heating printed circuit board 1110.

The buzzer 1085 outputs an audio sound to provide accurate failure information to a user when a failure has occurred on a water supply apparatus such as the water purifier 1000. The buzzer 1085 may output a specific audio sound of a preset code according to the failure.

The NFC printed circuit board 1084 is to send and receive data to and from a communication device. In recent years, personal communication devices such as a smart phone have been widely used. Accordingly, when a consumer is able to check the status of a water purifier or enter a control command using a personal communication device, it may be possible to enhance the convenience of the consumer. The NFC printed circuit board 1084 may provide the status information of a water supply apparatus to a personal communication device paired therewith, and receive a user's control command from the personal communication device.

The main printed circuit board 1086 controls the overall operation of a water supply apparatus such as the water purifier 1000. The operation of the input/output portion 1016 illustrated in FIG. 1 or the compressor 1051 illustrated in FIG. 2 may be also controlled by the main printed circuit board 1086. When power is insufficient, the main printed circuit board 1086 may receive the insufficient power through the noise printed circuit board 1083.

The main printed circuit board covers 1087, 1088 are configured to surround the main printed circuit board 1086. The main printed circuit board covers 1087, 1088 may include a first main cover 1087 and a second main cover 1088.

The main printed circuit board 1086 may be installed in an inner space formed by the first main cover 1087 and second main cover 1088.

The first main cover 1087 and second main cover 1088 are coupled to each other by the edges to prevent the infiltration of water. A sealing member may be installed on the first main cover 1087 and second main cover 1088 to prevent the infiltration of water. Furthermore, the first main cover 1087 and second main cover 1088 may be preferably formed of a flame retardant material to prevent the damage of the main printed circuit board 1086 due to fire.

An example structure of a hot water tank 1130 that prevents deformation and that enables flow rate distribution or flow speed control will be described. Additionally, a structure capable of maintaining a predetermined distance between the working coil 1140 and the hot water tank 1130 will be described.

Figure 5:
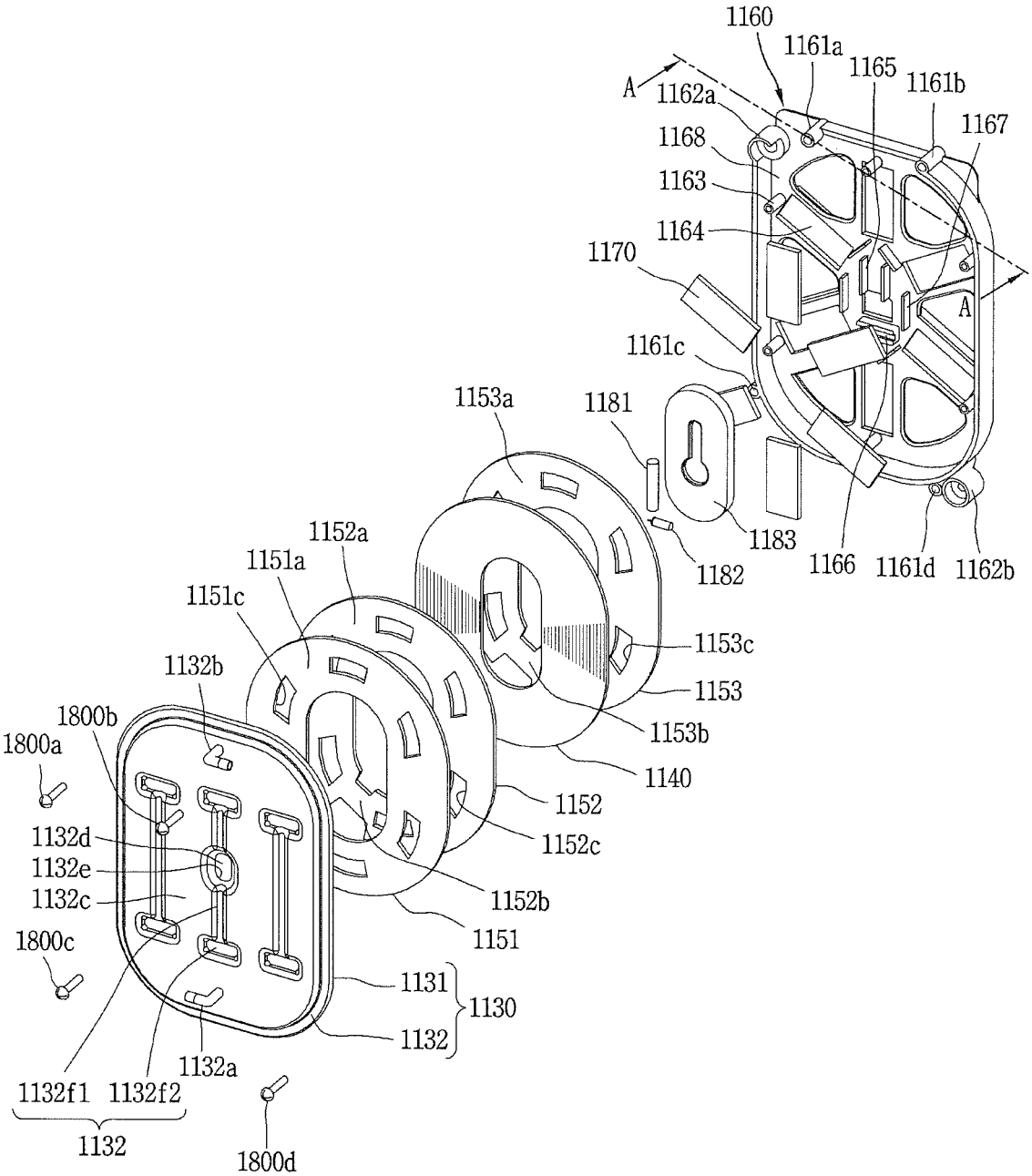
FIG. 5 is an exploded perspective view showing example parts of the example induction heating module.

FIG. 5 illustrates example parts of an example induction heating module.

The hot water tank 1130 is formed by coupling the edges of a first cover 1131 and a second cover 1132 to each other. An edge of the first cover 1131 and an edge of the second cover 1132 may be coupled to each other by welding or the like to maintain airtight sealing. The hot water tank 1130 is provided with an inner space for heating liquid. The inner space is formed by a coupling between the first cover 1131 and the second cover 1132.

The hot water tank 1130 may include an water inlet pipe 1132*a* and an water outlet pipe 1132*b*. Referring to FIG. 5, the water inlet pipe 1132*a* and water outlet pipe 1132*b* may be formed on the second cover 1132. The water inlet pipe 1132*a* defines a passage into which liquid to be heated enters. The water outlet pipe 1132*b* defines a passage to which liquid that has been heated is discharged. The water inlet pipe 1132*a* and water outlet pipe 1132*b* may be formed at opposite sides to each other.

The first cover 1131 is configured to receive the effect of magnetic field lines formed by the working coil 1140 to generate heat. The first cover 1131 receives induction heating by the working coil 1140, and thus a distance between the first cover 1131 and working coil 1140 may be constantly maintained to accurately control an induction heating output. Accurate control of induction heating denotes controlling the output of the induction heating module 1100.

If the working coil 1140 is getting out of a reference position, it is difficult to accurately control the induction heating output. Here, the reference position refers to a position of the working coil 1140 with respect to the first cover 1131 where induction heating may be accurately controlled. A distance between the first cover 1131 and the working coil 1140 is maintained by spacers 1151, 1152 which will be described later.

When a portion of the first cover 1131 is located too far from or too close to the working coil 1140 compared to the reference portion, it may be difficult to accurately control induction heating of the one portion. Accordingly, the first cover 1131 may have a flat shape to uniformly locate the entire portion of the first cover 1131 at a proper distance from the working coil 1140.

The first cover 1131 may be made of an appropriate material for generating Joule heating by induction. The first cover 1131 may be formed of a stainless material, and preferably formed of 4-series stainless steel. In some implementations, the first cover 1131 may be made of an STS (Stainless Steel, Korean Industrial Standard) 439 material. The STS 439 has an enhanced corrosion resistance compared to STS 430. Corrosion resistance is a material property indicating how well a substance withstands corrosion due to contact with water. The first cover 1131 may have a thickness of about 0.8 mm.

Because the second cover 1132 is disposed at an opposite side of the first cover 1131 with respect to the working coil 1140, the second cover 1132 will be in a lower effect zone in the magnetic field. Accordingly, the second cover 1132 may be formed of a material that has a good corrosion resistance rather than having a good heat generation characteristics. The second cover 1132 may be formed of a stainless material, for example, a 3-series stainless material. In some implementations, the second cover 1132 may be formed of an STS 304 material. The supporting member 304 has an enhanced corrosion resistance compared to the STS 439. The second cover 1132 may have a thickness of about 1.0 mm.

The second cover 1132 may not be required to maintain a predetermined distance from the working coil 1140 since the second cover 1132 is less relevant to induction heating. Accordingly, one portion of the second cover 1132 may be farther away from the working coil 1140 or disposed close to the working coil compared to the other portion thereof.

The second cover 1132 may include a base surface 1132*c*, a protruding surface 1132*d*, a welding portion 1132*e*, a protrusion portion 1132*f*. The base surface 1132*c*, protruding surface 1132*d* and protrusion portion 1132*f* may be integrally formed by pressing processing. When press processing is partially carried out on the second cover 1132 having the base surface 1132*c*, the protruding surface 1132*d* and protrusion portion 1132*f* may be formed on the second cover 1132. The base surface 1132*c*, protruding surface 1132*d* and protrusion portion 1132*f* may be made from a single part by a press process. The base surface 1132*c*, protruding surface 1132*d* and protrusion portion 1132*f* are designated names indicating different portions of the second cover 1132.

The base surface 1132*c* faces the first cover 1131 at a position separated from the first cover 1131. The hot water tank 1130 has been described to include an inner space for heating liquid. The base surface 1132*c* is separated from the first cover 1131 to form the inner space.

The protruding surface 1132*d* is protruded toward the first cover 1131 from the base surface 1132*c*. The protruding surface 1132*d* may be closely adhered to the first cover 1131. A circumference of the protruding surface 1132*d* connects the base surface 1132*c* to the protruding surface 1132*d*. During press processing to form the protruding surface 1132*d*, a circumference connected between the base surface 1132*c* and the protruding surface 1132*d* is naturally formed. The circumference of the protruding surface 1132*d* may be formed in an inclined manner.

The welding portion 1131*e* is formed by welding of the first cover 1131 and second cover 1132. Specifically, the welding portion 1131*e* is formed by welding of the first cover 1131 and the protruding surface 1132*d*. Accordingly, the welding portion 1131*e* may be formed on the first cover 1131 as well as formed on the protruding surface 1132*d*.

The base surface 1132*c* is separated from the first cover 1131 to form an inner space of the hot water tank 1130, and thus cannot be welded to the first cover 1131. Since the circumference of the protruding surface 1132*d* is away from the first cover 1131 as being closer to the base surface 1132*c*, it is difficult to be welded to the first cover 1131. The protruding surface 1132*d* is protruded to be closely adhered to the first cover 1131, and it is easily welded to the first cover 1131. The protruding surface 1132*d* is configured to form the welding portion 2131*e*.

The welding portion 1131*e* is to prevent the deformation of the first cover 1131. As the temperature of liquid increases within the hot water tank 1130 by the operation of the induction heating module 1100*a*, the liquid gradually expands and a pressure within the hot water tank 1130 gradually increases. It is known that when water evaporates, the volume increases by about 1700 times, and a pressure within the hot water tank 1130 may increase to a very high level during the hot water generation process. The rapid increase of the internal pressure in the hot water tank may cause the deformation of the first cover 1131.

While the first cover 1131 may be required to be a flat plate shape for an accurate control of induction heating, the flat shape may be difficult to prevent deformation due to a pressure increase. Therefore, the welding portion 1131*e* is introduced to prevent deformation of the first cover 1131.

Welding is an operation of locally applying heat to a position desired for adhesion to melt a part of metallic material and rearrange atomic bonds to adhere two metallic materials to each other. Adhesion by welding has a very strong binding force due to the rearrangement of atomic bonds. The welding portion 1131*e* is formed by welding of the protruding surface 1132*d* and first cover 1131, and thus it will be described that the first cover 1131 has the welding portion 1131*e*, and also will be described that the second cover 1132 has the welding portion 1131*e*, and will be described that the first cover 1131 and second cover 1132 have welding portion 1132*e*. Moreover, it may be also described that the welding portion 1131*e* is formed between the first cover 1131 and the second cover 1132. Though the welding portion of the second cover 1132 is not illustrated in FIG. 5, it may be possible to derive the shape and position thereof from the welding portion 1131*e* of the first cover 1131. The welding portion 1131*e* strongly couples the first cover 1131 to the second cover 1132, the deformation of the first cover 1131 may be prevented even though an internal pressure of the hot water tank 1130 is increased. Moreover, it may be understood that the welding portion 1131*e* can prevent the deformation of the second cover 1132 as well as the first cover 1131 in the aspect of coupling the first cover 1131 to the second cover 1132 each other.

The position of the welding portion 1132*e* is not limited to a specific location, but the welding portion 1132*e* may be formed at a position that does not overlap with the temperature sensor 1181. The overlapping position denotes the welding portion 1132*e* and temperature sensor 1181 being projected onto the same region when the working coil assembly 1140 is seen in the front side from the second cover 1132.

The temperature sensor 1181 is disposed at an opposite side of the second cover 1132 with the first cover 1131 in between. The temperature sensor 1181 is configured to measure the temperature of liquid passing through the inner space of the hot water tank 1130. When the temperature of liquid is measured by the temperature sensor 1181, the liquid may exist at a position overlapping with the temperature sensor 1181. However, if the welding portion 1131*e* is formed at a position overlapping with the temperature sensor 1181, the liquid does not exist at the overlapping position, but only the welding portion 1131*e* exists at the overlapping position. Therefore, the measured temperature from the temperature sensor 1181 may be inaccurate.

The welding portion 1131*e* has a closed curve shape. If the welding portion 1131*e* is formed in a shape having an end point such as a straight line or curved line, then the effect of a high pressure formed within the hot water tank 1130 is concentrated on the end point. In this case, a separation of the first cover 1131 from the second cover 1132 may occur at the end point. When the welding portion 1131*e* has a closed curve shape, the effect of a high pressure may be uniformly distributed on the closed curve shape without being concentrated on one portion thereof. Accordingly, the welding portion 1131*e* with a closed curve shape may enhance the breakdown performance of the hot water tank 1130.

The closed curve means a shape that has a start point that meets an end point. For example, a polygon, a circle, or an ellipse are examples of the closed curve. The perimeter can be either a curved line or a set of straight lines. Accordingly, a name such as a closed diagram or a single closed curve may be used instead of a name such as a closed curve.

The protrusion portion 1132*f* is protruded toward the first cover 1131 from the base surface 1132*c*. Unlike the protruding surface 1132*d* which may be closely adhered to the first cover 1131, the protrusion portion 1132*f* may maintain a separated state from the first cover 1131 without being closely adhered to the first cover 1131. However, the protrusion portion 1132*f* is formed closer to the first cover 1131 than the base surface 1132*c*.

The protrusion portion 1132*f* extends toward the water inlet pipe 1132*a* and water outlet pipe 1132*b* of the hot water tank 1130. For example, when the water inlet pipe 1132*a* and water outlet pipe 1132*b* are disposed at opposite sides based on a top-down direction of the hot water tank 1130, the protrusion portion 1132*f* may also extend in a top-down direction toward the water inlet pipe 1132*a* and water outlet pipe 1132*b*. The rigidity or strength of the second cover 1132 may be enhanced through the structure of the protrusion portion 1132*f* being protruded toward the first cover 1131 and extended toward the water inlet pipe 1132*a* and water outlet pipe 1132*b*.

The protrusion portion 1132*f* is provided for the deformation prevention of the second cover 1132 and the flow rate distribution of liquid (or flow speed control of liquid). As described above, when an internal pressure of the hot water tank 1130 increases, it may cause deformation of the second cover 1132 as well as the first cover 1131. The rigidity of the second cover 1132 is enhanced through the structure in which protrusion portion 1132*f* is extended in a protruded state, the deformation of the second cover 1132 may be prevented by the protrusion portion 1132*f* even when the internal pressure of the hot water tank 1130 increases. Moreover, the second cover 1132 is strongly coupled to the first cover 1131 by the welding portion 1131*e*, and therefore, the deformation of the second cover 1132 may be prevented by an interaction between the welding portion 1131*e* and the protrusion portion 1132*f*.

The protrusion portion 1132*f* has a predetermined width in a direction crossing an extension direction. For example, the extension direction of the protrusion portion 1132*f* is a top-down direction toward the water inlet pipe 1132*a* and water outlet pipe 1132*b*. A direction crossing the extension direction is a left-right direction. Since the protrusion portion 1132*f* has a predetermined width in a left-right direction, particles in liquid introduced through the water inlet pipe 1132*a* collide with the protrusion portion 1132*f*. The collided particles in liquid then are dispersed in all directions. Through such a mechanism, the protrusion portion 1132*f* may distribute a flow rate into various places within the hot water tank 1130.

The protrusion portion 1132*f* may control a flow speed. For example, the protrusion portion 1132*f* forms a flow resistance to reduce a flow speed of liquid. As particles in liquid introduced to the hot water tank 1130 through the water inlet pipe 1132*a* collide with the protrusion portion 1132*f*, they receive a resistance in the flow rate. Accordingly, when particles in liquid collide the protrusion portion 1132*f*, the flow speed of liquid decreases. It is to prevent the liquid from being excessively rapidly discharged without being sufficiently heated within the hot water tank 1130. The protrusion portion 1132*f* control a flow speed to allow the liquid to sufficiently stay in the hot water tank 1130. Accordingly, the liquid may be sufficiently heated within the hot water tank 1130.

A protrusion portion 1132*f* may include a first protrusion portion 1132*f*1 and a second protrusion portion 1132*f*2.

The first protrusion portion 1132*f*1 is extended toward a water inlet pipe 1132*a* and a water outlet pipe 1132*b* of the hot water tank assembly 1130. The first protrusion portion 1132*f*1 is to prevent the deformation of the second cover 3132 rather than the distribution of a flow rate. The first protrusion portion 1132*f*1 may have a smaller width than that of the first protrusion portion 1132*f*1.

The second protrusion portion 1132*f*2 extends in a direction crossing an extension direction of the first protrusion portion 1132*f*1. For example, the first protrusion portion 1132*f*1 extends in a top-down direction, and the second protrusion portion 1132*f*2 extends in a left-right direction.

A left-right extension length of the second protrusion portion 1132*f*2 is larger than a width of the first protrusion portion 1132*f*1. It is because the second protrusion portion 1132*f*2 is a configuration for distribution of a flow rate and control of a flow speed rather than that for deformation prevention of the second cover 1132. In order to disperse liquid to be heated from the hot water tank assembly 1130, the second protrusion portion 1132*f*2 may collide with particles in liquid. The extension width of the second protrusion portion 1132*f*2 is formed to be larger than that of the first protrusion portion 1132*f*1. Furthermore, the second protrusion portion 1132*f*2 may be relatively closer to the first cover 1131 compared to the first protrusion portion 1132*f*1 to provide a collision area.

The second protrusion portions 1132*f*2 may be formed at both end portions of the first protrusion portion 1132*f*1. When both the end portions of the first protrusion portion 1132*f*1 are referred to as a first end portion and a second end portion in FIG. 5, the first end portion is disposed closer to the water inlet pipe 1132*a*, and the second end portion is disposed closer to the water outlet pipe 1132*b*. The second protrusion portions 1132*f*2 may be formed at a first end portion and a second end portion of the first protrusion portion 1132*f*1 or formed between the first end portion and the second end portion.

The hot water tank 1130 may include a plurality of first protrusion portions 1132*f*1 second protrusion portions 1132*f*2. At least part of the plurality of second protrusion portions 1132*f*2 are disposed to be brought into contact with liquid introduced through the water inlet pipe 1132*a* or liquid to be discharged through the water outlet pipe 1132*b*. The contact with liquid denotes collision with liquid particles. The flow rate distribution and flow speed control may be carried out through the structure of the second protrusion portion 1132*f*2.

The second protrusion portions 1132*f*2 formed at a first end portion (an end portion at a side of the water inlet pipe 1132*a*) of the first protrusion portion 1132*f*1 are to distribute a flow rate and control a flow rate. Liquid particles introduced into the hot water tank 1130 through the water inlet pipe 1132*a* collide with the second protrusion portions 1132*f*2 to disperse a flow rate of liquid in all directions. As a result, liquid may be sufficiently heated within the hot water tank 1130.

The second protrusion portions 1132*f*2 formed at a second end portion (an end portion at a side of the water outlet pipe 1132*b*) of the first protrusion portion 1132*f*1 are to control a flow speed. When liquids are mixed prior to being discharged from the hot water tank assembly 1130 according to the control of a flow speed, hot water may be provided in a uniform temperature range.

The first protrusion portion 1132*f*1 and the second protrusion portion 1132*f*2 may be integrally formed by press processing. When press processing is carried out on the second cover 1132 having the base surface 1132*c* in consideration of an extension direction of the first protrusion portion 1132*f*1 and an extension direction of the second protrusion portion 1132*f*2, the first protrusion portion 1132*f*1 and second protrusion portion 1132*f*2 are integrally formed along with the base surface 3132*c*. Since a protruding surface 1132*d* can be formed by press processing, the protrusion portion 1132*f* and protruding surface 1132*d* may be formed at the same time by one time press processing.

The positions and number of the first protrusion portions 1132*f*1, the second protrusion portions 1132*f*2, and the welding portions 1132*e* may be selectively changed. The positions of the protrusion portions 1132*f* may not be necessarily limited. The protrusion portion 1132*f* may be also formed at a position overlapping with the temperature sensor 1181.

The working coil 1140 is disposed at one side of the hot water tank 1130. The working coil 1140 and hot water tank 1130 are disposed at separated positions to face each other. Referring to FIG. 5, it is illustrated that the working coil 1140 is disposed at a position facing an outer surface of the first cover 1131. For the sake of convenience of explanation, regarding the two surfaces of the first cover 1131, the surface facing the second cover 1132 is referred to as an inner surface, and the surface facing the working coil 1140 is referred to as an outer surface. Accordingly, one side of the hot water tank 1130 corresponds to a position facing an outer surface of the first cover 1131.

The working coil 1140 is formed by winding a conducting wire in an annular shape. The working coil 1140 may be formed with a single or several strands of copper or other conducting wires. When the working coil 1140 is formed with several strands of conducting wires, each strand is insulated.

The working coil 1140 forms a magnetic field or magnetic field lines by a current applied to the working coil 1140. The first cover 1131 receives the effect of magnetic field lines formed by the working coil 1140 to generate heat.

Since the hot water tank 1130 is induction-heated by the working coil 1140, it may be required to maintain a predetermined distance between the working coil 1140 and the hot water tank 1130. The spacers 1151, 1152 are disposed between the working coil 1140 and the hot water tank 1130 in order to maintain a predetermined distance between the working coil 1140 and the hot water tank 1130.

The spacers 1151, 1152 may require the following six conditions.

The first condition may be that even when the spacers 1151, 1152 are pressed by the hot water tank 1130 and the working coil 1140, the spacers 1151, 1152 are able to maintain a constant distance between the working coil 1140 and the hot water tank 1130. In order to accurately control induction heating, it has been described in the above that a distance between the hot water tank 1130 and the working coil 1140 may be constantly maintained. In a state that the spacers 1151, 1152 are disposed between the hot water tank 1130 and the working coil 1140, when one surface of the spacers 1151, 1152 is closely adhered to the hot water tank 1130 and the other surface of the spacers 1151, 1152 is closely adhered to the working coil 1140, a distance between the hot water tank 1130 and working coil 1140 is determined by a thickness of the spacers 1151, 1152.

If the spacers 1151, 1152 are pressed by the hot water tank 1130 and the working coil 1140 and elastically deformed, then the thickness of the spacers 1151, 1152 may become smaller than the original thickness. That is, the distance between the hot water tank 1130 and the working coil 1140 may not be maintained.

The example spacers 1151, 1152 having an appropriate strength may maintain an original thickness without elastic deformation even when pressed by the hot water tank 1130 and working coil 1140. Accordingly, the first condition of the spacers 1151, 1152 means that it may have a strength that does not deform even if pressed by the hot water tank 1130 and working coil 1140.

The second condition may be that the spacer 1151, 1152 may maintain electrical insulation between the hot water tank 1130 and the working coil 1140. A current is applied to the working coil 1140 for induction heating. If the current is conducted through the hot water tank 1130, which may affect the induction heating of the hot water tank 1130. It is because that induction heating is based on joule heating generated by an electrical resistance of the metal.

When an electrical insulation between the hot water tank 1130 and the working coil 1140 is not maintained, it is difficult to accurately control the induction heating of the hot water tank 1130. Since the spacers 1151, 1152 are disposed between the hot water tank 1130 and the working coil 1140, the spacers 1151, 1152 may be formed of an electrical insulator.

The third condition may be that the spacer 1151, 1152 may suppress heat transfer between the hot water tank 1130 and working coil 1140. When a current flows through the working coil 1140, both the working coil 1140 and the hot water tank 1130 may generate heat, and there is a danger of fire due to excessive heating by two heating elements.

Furthermore, the induction heating module 1100 is controlled based on a temperature measured by the temperature sensor 1181. When the temperature sensor 1181 is affected by too many elements, an accurate control of the induction heating module is gradually deteriorated, and thus the number of elements causing an effect on the temperature sensor 1181 may be preferably limited to accurately control the induction heating module 1100.

However, if heat transfer between the hot water tank 1130 and the working coil 1140 is not suppressed, the number of elements causing an effect on a temperature measured by the temperature sensor 1181 increases, and thus an accurate control of the induction heating module 1100 is gradually deteriorated. Since the spacers 1151, 1152 are disposed between the hot water tank 1130 and the working coil 1140, the spacers 1151, 1152 may suppress heat conduction between the hot water tank 1130 and the working coil 1140.

The fourth condition may be that the spacer 1151, 1152 may be formed of a flame retardant material having a high thermal resistance. The spacers 1151, 1152 are disposed between the working coil 1140 and the hot water tank 1130, and the temperature of the working coil 1140 and hot water tank 1130 may increase up to about 150° C. Therefore, if the spacers 1151, 1152 do not have a high thermal resistance, then it may be damaged by heat.

Accordingly, the spacers 1151, 1152 may be formed of a flame retardant material having a thermal resistance up to at least 200-300° C. not to be damaged even at a higher temperature that the heated working coil 1140 and the induction heated hot water tank 1130 might reach.

The spacers 1151, 1152 may be formed of any one of mica, quartz and glass to satisfy the first through the fourth condition. Mica, quartz or glass may maintain the thickness of itself even when pressurized by the hot water tank 1130 and working coil 1140, and they are flame retardant materials having electrical insulation, suppressed heat conduction, and sufficient thermal resistance properties.

In some implementations, the spacers 1151, 1152 may be formed of silicon (Si) to satisfy the second through the fourth condition. Silicon is a flame retardant material having electrical insulation, suppressed heat conduction, and sufficient thermal resistance properties. However, silicon may cause an elastic deformation when excessively pressurized by the hot water tank 1130 and working coil 1140. Accordingly, silicon may be used as a material of the spacer 1151, 1152 only when it is not excessively pressurized by the hot water tank 1130 and working coil 1140.

The fifth condition of the spacers 1151, 1152 may be that the spacers 1151, 1152 may have a structure capable of allowing the spacer 1151, 1152 to pass through both ends of the working coil 1140. The working coil 1140 is formed by a conducting wire in an annular shape, and an end thereof is extended from an inner side of the annular shape and connected to the induction heating printed circuit board 1110, and the other end of the working coil 1140 is extended from an outer side of the annular shape and connected to the induction heating printed circuit board 1110.

The spacers 1151, 1152 are formed in an annular shape to correspond to the working coil 1140, and may include a first portion 1151*a*, 1152*a* and a second portion 1152*b* (covered by the hot water tank) to allow both ends of the working coil 1140 to pass therethrough. The first portion 1151*a*, 1152*a* forms a part of the annular shape. The second portion 1152*b* forms the remaining part of the annular shape, and has a smaller width than that of the first portion 1151*a*, 1152*a*. In some implementations, the second portion 1152*b* may be recessed at an inner side and an outer side of the annular shape to have a smaller width than that of the first portion 1151*a*, 1152*a*. Accordingly, a gap capable of allowing both ends of the working coil 1140 to pass therethrough is formed at an inner side and an outer side of the annular shape. An end of the working coil 1140 passes through an inner side of the annular shape, and the other end of the working coil 1140 passes through an outer side of the annular shape.

The sixth condition of the spacers 1151, 1152 may be that the spacers 1151, 1152 may be formed with a structure capable of cooling the working coil 1140. The heat generated from the hot water tank 1130 by induction heating is transferred to liquid passing through the hot water tank 1130, that is, the hot water tank 1130 can be cooled by the liquid. The working coil 1140, however, is closely adhered to the spacers 1151, 1152 and an insulator 1153 that are configured to suppress heat transfer to the working coil 1140. Therefore, an alternative way to cool the working coil 1140 is convection through air.

Accordingly, an area capable of allowing the working coil 1140 to be sufficiently brought into contact with air may be provided to carry out the cooling of the working coil 1140. The spacers 1151, 1152 may include holes 1151*c*, 1152*c* for allowing the hot water tank 1130 and working coil 1140 to face each other. The holes 1151*c*, 1152*c* may be formed on the first portion 1151*a*, 1152*a*, and a plurality of holes 1151*c*, 1152*c* may be provided and formed to be separated from each other along the spacer 1151, 1152 in an annular shape.

The working coil 1140 and hot water tank 1130 are disposed to face each other at separated positions, and the working coil 1140 and hot water tank 1130 may face each other through the holes 1151*c*, 1152*c*. The working coil 1140 is separated from the hot water tank 1130, and thus the working coil 1140 may be brought into contact with air through the holes 1151*c*, 1152*c*. Accordingly, the holes 1151*c*, 1152*c* have a configuration for forming a contact area between the working coil 1140 and air.

Referring to FIG. 2, the water purifier 1000 may include a fan 1033, and wind generated by the fan 1033 promotes air flow within the water purifier 1000. Accordingly, when wind generated by the fan 1033 is transferred to the working coil 1140 through the holes 1151*c*, 1152*c*, it may further promote the cooling of the working coil 1140 compared to the natural convection of air.

A plurality of spacers 1151, 1152 may be provided therein. For example, when a distance between the hot water tank 1130 and the working coil 1140 may be constantly maintained at 3.5 mm, three gap spacers 1151 with a thickness of 1 mm and one spacer 1152 with a thickness of 0.5 mm may be disposed between the hot water tank 1130 and the working coil 1140. A plurality of the gap spacers may be disposed to be closely adhered to each other to determine a distance between the hot water tank 1130 and working coil 1140 by a thickness of the spacer 1151, 1152.

The insulator 1153 may be disposed at an opposite side of the spacers 1151, 1152 based on the working coil 1140. It may be understood that the insulator 1153 is disposed between the working coil 1140 and a bracket 1160 which will be described later. The insulator 1153 may also require the following five conditions. However, the condition in which a gap of the spacers 1151, 1152 may be maintained is not applicable to the insulator 1153.

The first condition may be that the insulator 1153 may maintain an electrical insulation between the working coil 1140 and a core 1170. The core 1170 is provided to suppress a loss of current, and ferrite is typically used for the material of the core 1170. Accordingly, when a current applied to the working coil 1140 is transferred to ferrite which is a conductive material, it interferes with a normal operation of the core 1170. Accordingly, the insulator 1153 may be formed of a material capable of maintaining electrical insulation.

The second condition may be that the insulator 1153 may suppress heat transfer between the working coil 1140 and the bracket 1160. The bracket 1160 may be formed by an injection mold, and an injection-molded product is typically weak to heat. Accordingly, when heat generated from the working coil 1140 is transferred to the bracket 1160, the bracket 1160 may be damaged by heat. The insulator 1153 may be formed of a material capable of suppressing heat transfer to prevent the bracket 1160 from being damaged by heat.

The third condition may be that the insulator 1153 may be formed of a flame retardant material having a heat resistance. The reason that the insulator 1153 may be formed of a flame retardant material having a heat resistance is the same as the reason that the spacers 1151, 1152 may be formed of a flame retardant material having a heat resistance.

The insulator 1153 may be formed of any one of mica, quartz, glass and silicon (Si) to satisfy the first through the third condition. Mica, quartz, glass and silicon are flame retardant materials having electrical insulation, suppressed heat conduction, and sufficient thermal resistance properties. In some implementations, the insulator 1153 does not require a condition associated with gap maintenance, and thus silicon may be used for the material of the insulator 1153 without any restriction.

The fourth condition of the insulator 1153 may have a structure capable of allowing the insulator 1153 to pass through both ends of the working coil 1140. Having a structure capable of allowing the insulator 1153 to pass through both ends of the working coil 1140 is the same as having a structure capable of allowing the spacer 1151, 1152 to pass through both ends of the working coil 1140. As a result, the insulator 1153 may substantially have the same structure as that of the spacers 1151, 1152. The insulator 1153 is formed in an annular shape to correspond to the working coil 1140, and may include a first portion 1153*a* and a second portion 1153*b* to allow both ends of the working coil 1140 to pass therethrough. The first portion 1153*a* forms a part of the annular shape. The second portion 1153*b* forms the remaining part of the annular shape, and has a smaller width than that of the first portion 1153*a*. In some implementations, the second portion 1153*b* is recessed from an inner circumference and from an outer circumference of the annular shape to have a smaller width than that of the first portion 1153*a*. Accordingly, a gap capable of allowing both ends of the working coil 1140 to pass therethrough is formed at an inner side and an outer side of the annular shape. An end of the working coil 1140 passes through an inner side of the annular shape, and the other end of the working coil 1140 passes through an outer side of the annular shape.

The fifth condition of the insulator 1153 may be that the insulator 1153 may be formed with a structure capable of implementing the cooling of the working coil 1140. The reason that the insulator 1153 may be formed with a structure capable of implementing the cooling of the working coil 1140 is the same as the reason that the spacers 1151, 1152 may be formed with a structure capable of implementing the cooling of the working coil 1140. A hole 1153*c* for making contact with air with the working coil 1140 is also formed on the insulator 1153 similarly to the spacers 1151, 1152.

As described above, the spacers 1151, 1152 and insulator 1153 may satisfy the same conditions excluding the gap maintenance condition. Accordingly, the spacers 1151, 1152, and insulator 1153 may be formed of the same material and have the same structure. The terms spacers 1151, 1152, and insulator 1153 may be merely provided to distinguish them from each other, but may not be necessarily distinguished as totally different configurations by those terms.

The bracket 1160 is formed to fix the hot water tank 1130 to an inside of the body of the water purifier 1000. Referring to FIG. 4, a front surface of the first main cover 1087 and the bracket 1160 have boss portions 1087*a*, 1087*b* and 1162*a*, 1162*b*, respectively. The positions of the two boss portions 1087*a*, 1087*b* and 1162*a*, 1162*b* may be changed according to the design as illustrated in FIGS. 4 and 5. When a screw is inserted into the boss portions 1087*a*, 1087*b* of the main printed circuit board cover 1087 through the boss portions 1162*a*, 1162*b* of the bracket 1160, the bracket 1160 is fixed to an inner portion of the body of the water purifier 1000. The bracket 1160 is coupled to the hot water tank 1130, and thus the bracket 1160 may fix the hot water tank 1130 to an inner portion of the body of the water purifier 1000.

Referring to FIG. 5, the bracket 1160 and hot water tank 1130 are coupled to each other by interposing the spacers 1151, 1152, working coil 1140 and insulator 1153 therebetween. A plurality of boss portions 1161*a*, 1161*b*, 1161*c*, 1161*d* are formed along the edge of the hot water tank 1130. The plurality of boss portions 1161*a*, 1161*b*, 1161*c*, 1161*d* are disposed to be separated from each other along the edge of the hot water tank 1130. The hot water tank 1130 and bracket 1160 are coupled to each other by screws 1800*a*, 1800*b*, 1800*c*, 1800*d* inserted into the boss portions 1161*a*, 1161*b*, 1161*c*, 1161*d*.

An edge of the hot water tank 1130 is disposed between a head of each screw 1800*a*, 1800*b*, 1800*c*, 1800*d* and each boss portion 1161*a*, 1161*b*, 1161*c*, 1161*d* in a state that the hot water tank 1130 and bracket 1160 are coupled to each other by the screws 1800*a*, 1800*b*, 1800*c*, 1800*d*. Due to such a structure, the hot water tank 1130 may be coupled to the bracket 1160 without having an additional hole for screw fastening.

When the bracket 1160 and hot water tank 1130 are coupled by the screws 1800*a*, 1800*b*, 1800*c*, 1800*d*, both surfaces of the spacers 1151, 1152 are closely adhered by the hot water tank 1130 and working coil 1140. The bracket 1160 and hot water tank 1130 can be coupled by the screws 1800*a*, 1800*b*, 1800*c*, 1800*d* because the spacers 1151, 1152 still maintains a gap between the hot water tank 1130 and the working coil 1140.

If a gap between the hot water tank 1130 and the working coil 1140 decreases during the process of coupling the bracket 1160 to the hot water tank 1130 by the screws 1800*a*, 1800*b*, 1800*c*, 1800*d*, then induction heating may not be accurately controlled. Because the spacers 1151, 1152 can maintain a predetermined gap between the hot water tank 1130 and the working coil 1140, the bracket 1160 and hot water tank 1130 may be coupled by the screws 1800*a*, 1800*b*, 1800*c*, 1800*d* without a problem in control of induction heating.

The bracket 1160 may include a base portion 1168, and the foregoing two boss portions 1161*a*, 1161*b*, 1161*c*, 1161*d*, 1162*a*, 1162*b* are formed along an edge of the base portion 1168. A plurality of hot tank support portions 1163 are protruded from the base portion 1168 to support the hot water tank 1130. The hot tank support portions 1163 may be formed to be separated from each other along a line corresponding to an edge of the hot water tank 1130. When an edge of the hot water tank 1130 is divided into an outer side and an inner side based on a distance from the center of the hot water tank 1130, the outer side is fixed to the boss portions 1161*a*, 1161*b*, 1161*c*, 1161*d* by the screws 1800*a*, 1800*b*, 1800*c*, 1800*d*, and the inner side is supported by the hot water tank 1130.

The bracket 1160 may include a plurality of core accommodation portions 1164 disposed in a radial shape. The core accommodation portions 1164 are formed to be recessed in a direction of being away from the insulator 1153. A plurality of cores 1170 are inserted into the core accommodation portions 1164.

The core 1170 is provided to suppress a loss of the current by shielding the magnetic field. Ferrite may be used for the material of the core 1170 as described above.

The temperature sensor 1181 is configured to measure the temperature of liquid heated in the hot water tank 1130. A temperature sensor accommodation portion 1165 receives the temperature sensor 1181 and is formed on the bracket 1160. The temperature sensor 1181 is inserted into the temperature sensor accommodation portion 1165. A center of the working coil 1140 is in an open area of its annular shape, and the temperature sensor 1181 may be disposed at the center or an inside of the annular shape of the working coil 1140.

The temperature measured by the temperature sensor 1181 is provided to the induction heating printed circuit board 1110 and the control module 1080 as illustrated in FIG. 4. The induction heating printed circuit board 1110 and the control module 1080 determine whether additional heating is needed based on the temperature of the liquid measured by the temperature sensor 1181. In other words, the output of the induction heating module 1100 may be determined based on the temperature measured on the temperature sensor 1181. A thermistor may be used for the temperature sensor 1181. The overheating protection fuse 1182 is a safety device that can block the power of the induction heating module 1100 when liquid in the hot water tank 1130 is overheated. While the temperature sensor 1181 is classified as a return sensor, the overheating protection fuse 1182 may be classified as a non-return sensor since it needs to be replaced once activated.

An overheating protection fuse accommodation portion 1166 receives the overheating protection fuse 1182 and is formed on the bracket 1160. The overheating protection fuse 1182 is inserted into the overheating protection fuse accommodation portion 1166. The overheating protection fuse 1182 may be disposed at the center or an inside of the annular shape of the working coil 1140 as the temperature sensor 1181 is located.

The bracket 1160 may include a position fixing portion 1167. The position fixing portion 1167 may formed by protruding from the base portion 1168 along a line corresponding to an annular inner circumference of the working coil 1140 to fix the position of the working coil 1140, the spacers 1151, 1152 and the insulator to support an inner circumference thereof. A position fixing portions 1167 may be provided therein, and disposed to be separated from each other.

The position of the working coil 1140, the spacers 1151, 1152 and the insulator 1153 is fixed by the position fixing portion 1167 of the bracket 1160, and the working coil 1140, the spacers 1151, 1152 and the insulator 1153 are closely adhered to each other by the hot water tank 1130 coupled to the bracket 1160. Accordingly, the position of the working coil 1140, the spacers 1151, 1152 and the insulator 1153 may be fixed even without any additional fixing structure or sealant to maintain a gap between the hot water tank 1130 and the working coil 1140 with a predetermined distance.

Moreover, a coupling structure with a sealant may bring different operation results. There may be difficulty in control of induction heating according to the operation result. Accordingly, the coupling structure with a sealant may be a disadvantage for a mass production. A coupling structure with screws 1800*a*, 1800*b*, 1800*c*, 1800*d* may not lead to a different operation result regardless of processes and be an advantage over the coupling structure with a sealant.

A silicon cover 1183 is coupled to the bracket 1160 to cover the temperature sensor 1181 and the overheating protection fuse 1182. The silicon cover 1183 may be configured to surround an outer circumferential surface of the position fixing portion 1167. The silicon cover 1183 may include a hole to efficiently measure a temperature of the temperature sensor 1181.

Figure 6:
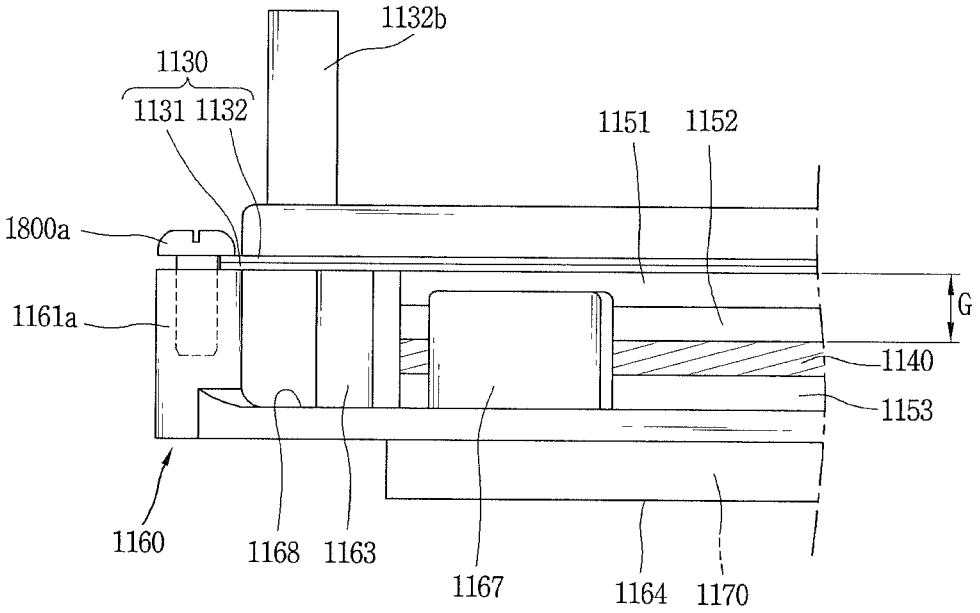
FIG. 6 is a cross-section view taken along the section line A-A of FIG. 5 showing an example coupling structure of the example induction heating module.

FIG. 6 illustrates a side view of a configuration corresponding to line A-A in FIG. 5 to show a coupling structure of an induction heating module 1100. FIG. 6 also illustrates a structure in which an edge of the hot water tank 1130 is coupled to the boss portion 1161*a* of the bracket 1160 by a screw 1800*a*. An edge of the hot water tank 1130 is formed at a position corresponding to the boss portion 1161*a* of the bracket 1160. When the screw 1800*a* is fastened to the boss portion 1161*a*, an edge of the hot water tank 1130 is disposed between a head of the screw 1800*a* and the boss portion 1161*a*.

Referring to FIG. 6, the insulator 1153, working coil 1140 and spacers 1151, 1152 are stacked between the first cover 1131 and the base portion 1168 of the bracket 1160. The base portion 1168 of the bracket 1160, insulator 1153, working coil 1140, spacers 1151, 1152, and first cover 1131 are disposed to be closely adhered to each other. Regarding FIG. 6, a gap G between the working coil 1140 and the hot water tank 1130 is constantly maintained.

The water outlet pipe 1132*b*, the second cover 1132, the hot water tank support portion 1163, the position fixing portion 1167, the core accommodation portion 1164, and the core 1170 will be substituted by the description of FIG. 5.

An example spacer disposed between the hot water tank and the working coil may be made of material including mica, quartz, or glass to maintain a constant gap between the hot water tank and the working coil.

In some implementations, a thickness of the spacer may be constantly maintained even when the spacer is pressed as the hot water tank and the bracket are coupled to each other by a screw. The spacer may maintain a state of being closely adhered to the hot water tank and the working coil, and thus a gap between the hot water tank and the working coil is determined by the spacer. Accordingly, constantly maintaining a thickness of the spacer denotes constantly maintaining a gap between the hot water tank and the working coil.

Even when the hot water tank and the bracket are coupled to each other by a screw, it may be possible to maintain a gap between the hot water tank and the working coil. According to a structure of the present disclosure, the positions of the working coil, hot water tank, and the spacer may be fixed without using any sealant.

Additionally, because a screw fastened structure may not bring a different result regardless of the process and may be favourable for a mass production.

The spacer and the insulator may be made of material including mica, quartz, glass, or silicon. It may be possible to obtain an effect of suppressing heat transfer. In some implementations, when heat generated from the induction heating module is transferred to adjoining components, it may cause damage due to the heat, but when heat transfer is suppressed by the spacer and the insulator, it may be possible to prevent damage due to the heat.

The spacer and the insulator may include a hole to secure a contact area between the working coil and air. Accordingly, it may be possible to implement air cooling of the working coil while maintaining a constant gap between the working coil and the hot water tank.

What is claimed is:

1. A water purifier, comprising:

a case comprising a base that defines a bottom of the water purifier;

a filter portion installed at an inside of the case; and an induction heating module configured to heat purified water having passed through the filter portion, wherein the induction heating module includes:

a bracket mounted inside the case and disposed perpendicular to the base, a hot water tank coupled to one side of the bracket, a water inlet pipe disposed at a lower part of the hot water tank, a water outlet pipe disposed at an upper part of the hot water tank, a working coil that is disposed at one side of the hot water tank and that faces the hot water tank, the working coil comprising a conducting wire wound in an annular shape and being configured to generate magnetic field lines for induction heating of the hot water tank, and a spacer that is located between the working coil and the hot water tank, wherein the hot water tank includes:

a first cover that faces the working coil and that has a flat shape, a second cover that is coupled to the first cover to thereby define an inner space for water flow in the hot water tank, the second cover having an edge coupled to an edge of the first cover and configured to maintain airtight sealing of the inner space of the hot water tank, a longitudinal protrusion portion that extends along a longitudinal direction corresponding to a top-down direction of the water flow in the inner space of the hot water tank, and a horizontal protrusion portion that extends along a horizontal direction crossing the longitudinal direction, and wherein an extension length of the longitudinal protrusion portion in the longitudinal direction is greater than an extension length of the horizontal protrusion portion in the horizontal direction.

2. The water purifier of claim 1, wherein the spacer is configured to maintain a constant thickness based on being pressed inward by a coupling force between the hot water tank and the bracket.

3. The water purifier of claim 1, wherein the spacer is made from mica.

4. The water purifier of claim 1, wherein the spacer is made from glass.

5. The water purifier of claim 1, wherein the spacer is made from silicon.

6. The water purifier of claim 1, the spacer comprises a plurality of spacers that are adhered to each other.

7. The water purifier of claim 1, wherein a first surface of the spacer is adhered to the hot water tank, a second surface of the spacer opposite the first surface is adhered to the working coil, and a thickness of the spacer determines a gap between the hot water tank and the working coil.

8. The water purifier of claim 1, wherein:

the spacer has a shape that extends to inner and outer sides of the working coil; and the spacer includes:

a first portion that radially extends to at least one of the inner side or the outer side of the working coil, and a second portion that is narrower than the first portion in a radial direction.

9. The water purifier of claim 1, wherein the hot water tank and the working coil are exposed to each other through a hole that is defined in a surface of the spacer.

10. The water purifier of claim 1, wherein:

the bracket includes a plurality of boss portions that are spaced apart from each other and that are arranged to correspond to an edge of the hot water tank, each of the plurality of boss portions being configured to receive a screw;

the hot water tank and the bracket are coupled to each other by the screws inserted through the plurality of boss portions; and the edge of the hot water tank is located between a head of each of the screws and each of the plurality of boss portions.

11. The water purifier of claim 1, wherein the bracket comprises:

a base portion that faces toward the working coil; and a plurality of hot water tank support portions that are spaced apart from each other, that protrude from the base portion, and that are configured to support the hot water tank.

12. The water purifier of claim 1, further comprising an insulator that is located between the working coil and the bracket and that is configured to restrict heat conduction between the insulator and the working coil.

13. The water purifier of claim 12, wherein the insulator is made from mica.

14. The water purifier of claim 12, wherein the insulator is made from glass.

15. The water purifier of claim 12, wherein the insulator is made from silicon.

16. The water purifier of claim 12, wherein the insulator defines a hole in a surface of the insulator.

17. The water purifier of claim 12, wherein each of the spacer and the insulator has a shape that extends to inner and outer sides of the working coil, the insulator including:

a first portion that radially extends to at least one of the inner side or the outer side of the working coil, and a second portion that is narrower than the first portion in a radial direction.

18. The water purifier of claim 17, wherein the bracket includes a position fixing portion that protrudes toward the working coil along an inner circumference of the working coil and that is configured to guide the working coil, the spacer, and the insulator to a fixed position.

19. The water purifier of claim 17, wherein the water purifier comprises:

a temperature sensor that is located at the inner side of the working coil and that is configured to measure a temperature; and a fuse that is located at the inner side of the working coil and that is configured to operate based on the temperature being above a preset temperature, and wherein the induction is controlled based on the temperature measured by the temperature sensor.

20. The water purifier of claim 1, wherein the extension length of the horizontal protrusion portion in the horizontal direction is greater than a width of the longitudinal protrusion portion in the horizontal direction.

* * * * *